US010550753B2

(12) United States Patent
Steiner et al.

(10) Patent No.: US 10,550,753 B2
(45) Date of Patent: Feb. 4, 2020

(54) CYLINDER BLOCK OF AN INTERNAL COMBUSTION ENGINE

(71) Applicant: Ford Global Technologies, LLC, Dearborn, MI (US)

(72) Inventors: Bernd Steiner, Bergisch Gladbach (DE); Klaus-Peter Heinig, Aachen (DE); Dietmar Hohmann, Erkrath (DE)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 15/947,594

(22) Filed: Apr. 6, 2018

(65) Prior Publication Data

US 2018/0306095 A1 Oct. 25, 2018

(30) Foreign Application Priority Data

Apr. 21, 2017 (DE) ..... 10 2017 206 716

(51) Int. Cl.

| | |
|---|---|
| ***F01P 3/02*** | (2006.01) |
| ***F01P 7/16*** | (2006.01) |
| ***F02F 1/14*** | (2006.01) |
| ***F02F 1/40*** | (2006.01) |

(52) U.S. Cl.

CPC ..... *F01P 3/02* (2013.01); *F01P 7/165* (2013.01); *F02F 1/14* (2013.01); *F02F 1/40* (2013.01); *F01P 2003/027* (2013.01)

(58) Field of Classification Search

CPC ..... F02F 1/14; F02F 1/10; F01P 2003/021

See application file for complete search history.

(56) References Cited

U.S. PATENT DOCUMENTS

| | | | | |
|---|---|---|---|---|
| 4,369,739 | A | 1/1983 | Umemura et al. | |
| 4,693,294 | A * | 9/1987 | Albrecht | F02F 1/108 123/41.74 |
| 5,474,040 | A * | 12/1995 | Murakami | F02F 7/0007 123/195 R |
| 2006/0011151 | A1* | 1/2006 | Huter | F01P 3/02 123/41.29 |
| 2013/0333658 | A1* | 12/2013 | Yamamoto | F02F 1/10 123/195 R |

(Continued)

FOREIGN PATENT DOCUMENTS

| | | | |
|---|---|---|---|
| DE | 102005040960 | A1 | 3/2007 |
| DE | 202016104442 | U1 | 9/2016 |

(Continued)

*Primary Examiner* — Long T Tran

(74) *Attorney, Agent, or Firm* — Geoffrey Brumbaugh; McCoy Russell LLP

(57) ABSTRACT

A cooling system in an engine is provided. The cooling system includes a cylinder bore including a central axis, a coolant duct including a first section positioned on a first side of the cylinder bore and a second section positioned on a second side of the cylinder bore, a connecting duct extending between the first section and the second section and including a first end opening into the first section and a second end opening into the second section. The connecting duct includes a first subsection and a second subsection extending inwardly toward the central axis and an intersection of the first subsection and the second subsection in a plane perpendicular to the central axis form a non-straight angle.

20 Claims, 3 Drawing Sheets

(56) References Cited

U.S. PATENT DOCUMENTS

| | | | | |
|---|---|---|---|---|
| 2016/0281583 | A1* | 9/2016 | Michikawauchi | F01P 3/02 |
| 2018/0135504 | A1* | 5/2018 | Quix | F01P 11/04 |

FOREIGN PATENT DOCUMENTS

| | | | |
|---|---|---|---|
| EP | 0197365 | A2 | 10/1986 |
| EP | 0223158 | A1 | 5/1987 |
| EP | 0974414 | A1 | 1/2000 |
| EP | 2309106 | A1 | 4/2011 |
| EP | 2309114 | A1 | 4/2011 |
| EP | 2325453 | A1 | 5/2011 |
| JP | H05141307 | A | 6/1993 |

* cited by examiner

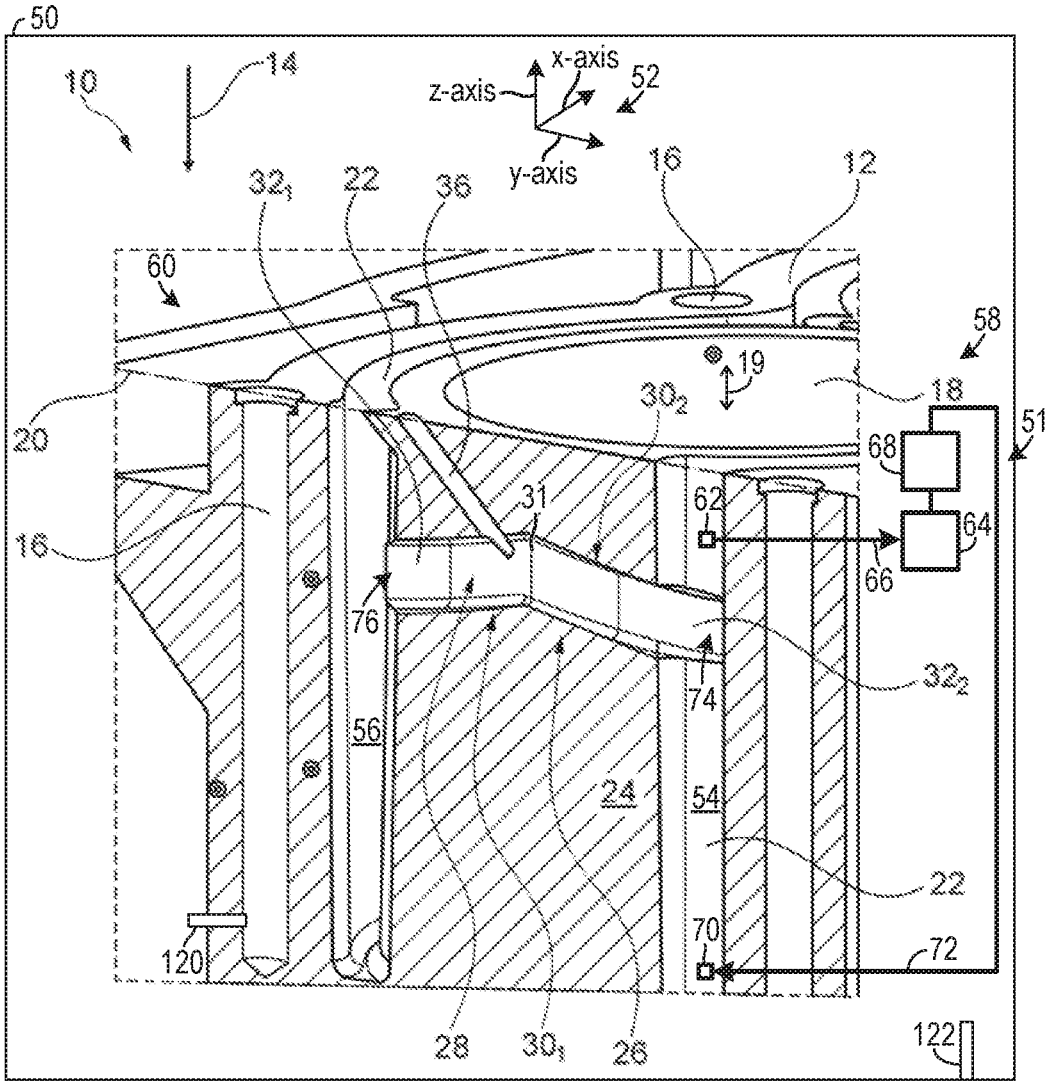
FIG. 1
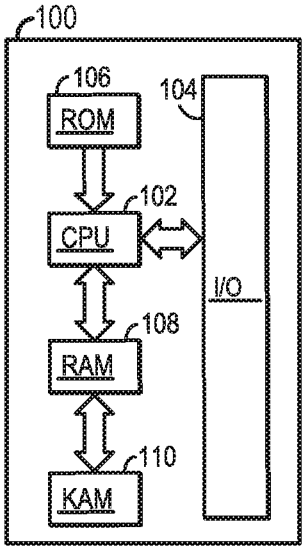

CYLINDER BLOCK OF AN INTERNAL COMBUSTION ENGINE

CROSS REFERENCE TO RELATED APPLICATION

This application claims priority to German Patent Application No. 102017206716.0, filed Apr. 21, 2017. The entire contents of the above-referenced application are hereby incorporated by reference in its entirety for all purposes.

FIELD

The present description relates generally to a cylinder block of an internal combustion engine with a cooling system.

BACKGROUND/SUMMARY

In the field of internal combustion engines, it is known to allow cooling in a coolant circuit to separately flow through the engine block and cylinder head of the internal combustion engine. The cylinder head, which is thermally coupled to the combustion gas especially through the combustion chamber and duct walls, and the engine block, which is thermally coupled especially to the friction points, can thereby be cooled differently. Systems which allow the cylinder head and block to be separately cooled are referred to as "split-cooling systems". In such systems, in the hot-running phase of the internal combustion engine, the cylinder head may be cooled upstream of the engine block, as a result of which the engine block can be brought up to a desired operating temperature more rapidly.

For example, EP 2 309 106 A1 describes an internal combustion engine which has a coolant circuit which is divided into a cylinder-block-side coolant region and into a cylinder-head-side coolant region. The cylinder-block-side coolant region has at least one block thermostat. The cylinder-head-side coolant region has an outlet-side cooling region and an inlet-side cooling region, wherein coolant can be conducted from the inlet-side cooling region into an outlet housing, into which the outlet-side cooling region leads. A coolant pump outlet is connected to the cylinder-block-side coolant region via the block thermostat. Arranged upstream of the block thermostat is at least one branch which conducts a first partial flow in the direction of the outlet-side cooling region of the cylinder-head-side coolant region, wherein the at least one branch is directly connected to the coolant pump outlet. The coolant flowing through the block thermostat flows through the cylinder-block-side coolant region and from there enters the inlet-side cooling region of the cylinder-head-side coolant region. The cylinder-block-side coolant region is connected to the inlet-side cooling region through a cylinder head seal. The outlet housing has a control element. The coolant flowing out of the outlet-side and inlet-side cooling region are mixed in the direction of flow upstream of the control element in the outlet housing. The two coolant flows entering the outlet housing are free of contact until they are mixed.

However, the inventor has recognized several drawbacks with EP 2 309 106 A1 and other previous cylinder block cooling systems. For instance, the cooling conduits in the cylinder block may compromise the structural integrity of the cylinder block. As a result, the durability and longevity of the cylinder block may be decreased.

To address at least some of the aforementioned problems a cooling system is provided. In one example, the cooling system includes a cylinder bore including a central axis, a coolant duct including a first section positioned on a first side of the cylinder bore and a second section positioned on a second side of the cylinder bore, a connecting duct extending between the first section and the second section and including a first end opening into the first section and a second end opening into the second section. The connecting duct includes a first subsection and a second subsection extending inwardly toward the central axis and an intersection of the first subsection and the second subsection in a plane perpendicular to the central axis form a non-straight angle. Arranging the first and second subsections of the connecting duct at a non-straight angle enables the structural integrity of the cylinder block to be increased while providing a desired amount of cooling to the cylinder block. In this way, increased cylinder block cooling may be achieve without compromising the structural integrity of the block, if desired. As a result, engine efficiency can be increased, engine emissions can be reduced, and engine longevity can be increased, if desired.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIG. 1 shows a cylinder block in an internal combustion engine and a cooling system in a sectioned perspective partial view from above.

FIGS. 2-3F are shown approximately to scale. However, other relative dimensions may be used, in other examples, if desired.

DETAILED DESCRIPTION

Figure 2:
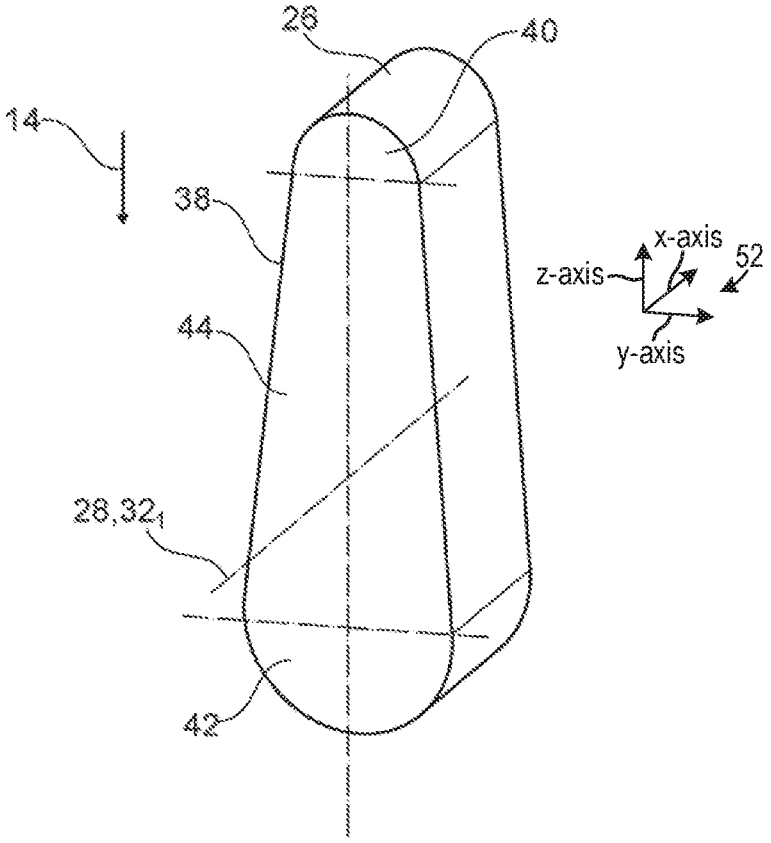
FIG. 2 shows a cross-sectional area of the connecting duct of the cylinder block shown in FIG. 1.

Coolant ducts have been provided in engine cylinder blocks to dissipate heat generated during combustion operation. Moreover, the development of modern internal combustion engines is aimed at a more compact construction as well as engine power gains. In order to be able to obtain a compact construction of a cylinder block, into which cylinder bores extend from an upper side of the cylinder block, the cylinder bores may be arranged close together in the cylinder block, which results in a reduction in the width or thickness of a web arranged between two adjacent cylinder bores.

However, said webs are exposed thermally and mechanically to particular loads as a consequence of their closeness to the combustion operations in the internal combustion engine. Proposals are known from the prior art which aim at improving cooling of the web arranged between two adjacent cylinder bores.

For example, EP 2 325 453 B1 describes an internal combustion engine which has a coolant circuit which is divided into a cylinder-block-side coolant region and into a cylinder-head-side coolant region. The cylinder block has at least one cylinder block web in which a cooling slot is arranged, said cooling slot being covered opposite its slot base by a cylinder head seal. At a slot base, the cooling slot has a radius, the value of which is smaller than its slot width. With such a configuration of the slot base, a harmonious transition from slot walls of the cooling slot to the slot base is achieved, the transition bringing about a reduction in stress peaks in the cylinder block and an increase in the load-bearing capacity of the component.

Furthermore, EP 2 309 114 B1 likewise describes an internal combustion engine which has a coolant circuit which is divided into a cylinder-block-side coolant region and into a cylinder-head-side coolant region, and the cylinder block has at least one cylinder block web in which a cooling slot is arranged. An outlet which is connected to the cylinder-head-side coolant region is arranged in the cylinder head. Arranged in the cylinder head is a passage through which the cylinder-block-side coolant region is connected to the cooling slot which, in turn, is connected to the outlet. Coolant can be flowed out of the cylinder-block-side coolant region via the passage into the cooling slot and from there via the outlet into the cylinder-head-side coolant region.

DE 20 2016 104 442 U1 describes a cylinder block for a multi-cylinder internal combustion engine. The cylinder block has at least two cylinder bores which extend from an upper side of the cylinder block into the latter. A web is arranged between the cylinder bores and extends from the upper side of the cylinder block between the cylinder bores into the cylinder block. The cylinder block comprises a coolant duct which surrounds the cylinder bores at least partially circumferentially and runs outside the web, for cooling the cylinder bores by means of a cooling fluid, and a cooling slot extending in the web from the upper side of the cylinder block into the latter. The cooling slot is connected in a fluid-conducting manner to the coolant duct via at least one connecting duct. A cooling slot depth extending at right angles to the upper side of the cylinder block from said upper side as far as a slot base of the cooling slot is smaller, with respect to its longitudinal extent, in a central portion of the cooling slot than in an intermediate portion of the cooling slot that is arranged between an edge portion and the central portion. As a result, the web is considerably mechanically strengthened in particular in its weakest portion, namely the central portion which is defined by the thinnest wall thickness of the web between the cylinder bores. At the same time, cooling of the web can be carried out by the coolant which is located in the cooling slot and is connected in a fluid-conducting manner to the coolant duct.

EP 0 197 365 A2 describes a cylinder block of a reciprocating piston internal combustion engine and an apparatus for the production of said cylinder block, wherein the cylinder block comprises cylinders which are cast together in an extremely close-fitting manner and the cylinder walls of which are surrounded on both longitudinal sides and end sides of the cylinder block by a cooling water casing. At least level with the cylinder combustion chambers, the narrow webs between adjacent cylinders in each case have at least one pre-formed cooling water duct which directly connects the two longitudinal halves of the cooling water casing to each other.

In view of the previous engine cooling system designs, the field of cooling a cylinder block of an internal combustion engine still provides room for improvements.

The engine with the cylinder block and cooling system, described herein, may be designed with the objective of providing a cylinder block of an internal combustion engine with improved cooling of webs arranged between cylinder bores of the cylinder block, with a desired mechanical strength of the webs being achieved. In other words, the cooling system described herein may be designed, in one example, to increase cylinder block cooling without unduly compromising the structural integrity of the cylinder block.

The objective may be achieved, in one example, by a cylinder block with at least a portion of the cooling features described herein.

It is pointed out that the features and measures listed individually in the description below can be combined with one another in any technically expedient manner and present further refinements of the engine, cylinder block, and associated cooling system. The description characterizes and more precisely explains the engine, cylinder block, and associated cooling system in particular additionally in conjunction with the figures.

The cylinder block of an internal combustion engine described herein may have at least two cylinder bores which extend from an upper side of the cylinder block into the latter. A web of the cylinder block, which web is arranged between the cylinder bores, extends from the upper side of the cylinder block between the cylinder bores into the cylinder block. The cylinder block furthermore may include a coolant duct which surrounds the cylinder bores at least partially circumferentially and runs outside the web, for cooling the cylinder bores by means of a coolant. In addition, the cylinder block has a connecting duct which may be arranged (e.g., completely arranged) within the web and may produce a connection in terms of flow between parts of the coolant duct that are otherwise separated by the web.

At subsections that are connected directly to the coolant duct, a center line of the connecting duct may form an obtuse angle with a direction arranged perpendicular to the upper side of the cylinder block, on a side facing away from the upper side of the cylinder block.

As described herein, the term "arranged completely within the web" is intended to be understood in particular as meaning that the subsections of the connecting duct that are connected directly to one of the coolant ducts are arranged spaced apart from the upper side of the cylinder block.

Within the context of the description, the term "center line" is intended to be understood in particular as meaning a connecting line of area center points of cross-sectional areas of the connecting duct perpendicular to the extent thereof.

In one example, an outer surface, serving for removing heat, of the connecting duct may be enlarged. In addition, forces occurring in the region of the upper side of the cylinder block during operation of the internal combustion engine may be more desirably dissipated, as a result of which a deformation of the web can be at least reduced, which can permit an increased dimensional stability during operation of the internal combustion engine.

The size of the obtuse angle may be between 105° and 130°, and, particularly may be, between 110° and 120°, in some examples.

The connecting duct may be produced using a manufacturing method. In one example, the connecting duct may be formed using a lost casting mold core made from salt, carbon and/or glass. An example of a lost casting method is described in EP 0 974 414 A1. However, other suitable manufacturing methods have been contemplated. For instance, the connecting duct may be machined (e.g., drilled) in the cylinder block subsequent to casting.

In one example, in the cylinder block, a center line of the connecting duct may lie substantially completely in a plane of symmetry of two adjacently arranged cylinder bores of the at least two cylinder bores. A symmetrical and uniform dissipation of heat from the region of the web can thereby be achieved.

In one example, the connecting duct may have at least two subsections with a rectilinear center line. The connecting duct can thereby be provided in a structurally simple manner. Consequently, manufacturing may be simplified, thereby reducing manufacturing costs. Arranging the connecting duct with the aforementioned subsections may also increase the structural integrity of the cylinder block.

If the connecting duct has at least two subsections with a rectilinear center line, and the center lines of two abutting subsections form an obtuse angle on a side facing away from the upper side of the cylinder block, a structurally simple solution for the connecting duct can be provided, if desired. Simplifying the profile of the connecting duct can thereby reduce manufacturing costs as well as increase structural integrity of the cylinder block.

The terms "first", "second", etc., used in this application serve for the purpose of differentiation. In particular, the use thereof is not intended to imply any sequence or priority of the objects referred to in conjunction with said terms.

In other examples of the cylinder block, a cross-sectional area of the connecting duct may have a first circular-segment-shaped area portion, a second circular-segment-shaped area portion and a trapezoidal area portion, in a plane perpendicular to the center line, where the trapezoidal area portion is arranged between the first and the second circular-segment-shaped area portions.

A cross-sectional area of the connecting duct designed in this manner permits a particularly advantageous absorption and dissipation of forces occurring during operation of the internal combustion engine, making it possible to achieve a more uniform local distribution of the mechanical stress, if desired. Furthermore, the flow behavior of the coolant in the connecting duct can be improved, if desired. For instance, the coolant flow may be distributed to additional areas in the cylinder block such as a cylinder bridge, thereby increase the amount of heat that may be removed from the cylinder block. Moreover, the flowrate of coolant through the cylinder block may be increased when the cooling system includes a connecting duct.

The first circular-segment-shaped area portion may have an area which is smaller than an area of the second circular-segment-shaped area portion, in one example. This makes it possible to achieve a droplet-like cross-sectional shape with the connecting duct having particularly high mechanical strength.

Particularly high mechanical strength of the connecting duct may be achieved in particular when the first circular-segment-shaped area portion is arranged closer to the upper side of the cylinder block than the second circular-segment-shaped area portion, in one example.

In another example of the cylinder block, at least one of the circular-segment-shaped area portions may be designed as a semicircular area. This makes it possible to avoid corners in the cross-sectional area of the connecting duct at a transition of the circular-segment-shaped area portion to the trapezoidal area portion, as a result, at said transition, a favorable absorption and dissipation of force and particularly low hydraulic losses of a coolant flowing through the connecting duct may be achieved.

Both the first circular-segment-shaped area portion and the second circular-segment-shaped area portion, in one example, may be designed as a semicircular area. In this case, the cross-sectional area of the connecting duct may be designed with avoidance of corners, and the favorable absorption and dissipation of force and the particularly low hydraulic losses may be obtained for the connecting duct (e.g., entire connecting duct).

In one example of the cylinder block, a venting duct may be provided which connects a sub-region of the connecting duct, said sub-region facing toward (e.g., closest towards) the upper side of the cylinder block, to the upper side of the cylinder block in terms of flow. In this manner, the vapor bubbles potentially arising in the coolant due to heating in a hot-running phase of the internal combustion engine, in particular when a split-cooling system is used, may be removed and therefore a coolant flow through the connecting duct can be maintained, as a result of which the cooling of the web can be improved.

In one particular example, a coolant duct may be arranged on a lower side of the cylinder head. Therefore, the venting duct allows a connection in terms of flow from the connecting duct to the coolant duct of the cylinder head to be produced through an opening provided in a cylinder head seal, if desired.

In one example, the cylinder block described herein may be used for a multi-cylinder internal combustion engine in a motor vehicle.

Further advantageous features of the engine, cylinder block, cooling system, etc., are described in description below of the figures.

FIG. 1 shows an engine 50 including a cylinder block 10 with a cooling system 51 designed to remove heat generated during combustion in the engine. Specifically, the engine 50, cylinder block 10, and cooling system 51, are shown in cross-section in a perspective view. Additionally, reference axes 52 are illustrated for reference in FIG. 1 as well as FIGS. 2-3F. The reference axes 52 include an x-axis, y-axis, and/or z-axis depending on the figure view. The z-axis may be parallel to a gravitational axis, in one example. Additionally, the x-axis may be a lateral axis and/or the y-axis may be a longitudinal axis, in some examples. However, in other examples alternate orientations of the x-axis, y-axis, and/or z-axis have been contemplated. It will be appreciated that the engine 50 may also include a cylinder head (not shown) coupled to the cylinder block 10 to form cylinder bores 18. A central axis 19 of one of the cylinder bores 18 is illustrated in FIG. 1 for reference.

During engine operation, the cylinders in the cylinder bores 18 typically undergoes a four-stroke cycle including an intake stroke, compression stroke, expansion stroke, and exhaust stroke. During the intake stroke, generally, the exhaust valve closes and intake valve opens. Air is introduced into the combustion chamber via the corresponding intake conduit, and the piston moves to the bottom of the combustion chamber so as to increase the volume within the combustion chamber. The position at which the piston is near the bottom of the combustion chamber and at the end of its stroke (e.g., when the combustion chamber is at its largest volume) is typically referred to by those of skill in the art as bottom dead center (BDC). During the compression stroke, the intake valve and the exhaust valve are closed. The piston moves toward the cylinder head so as to compress the air within combustion chamber. The point at which the piston is at the end of its stroke and closest to the cylinder head (e.g., when the combustion chamber is at its smallest volume) is typically referred to by those of skill in the art as top dead center (TDC). In a process herein referred to as injection, fuel is introduced into the combustion chamber. In a process herein referred to as ignition, the injected fuel in the combustion chamber is ignited via a spark from an ignition device, resulting in combustion. However, in other examples, compression may be used to ignite the air fuel mixture in the combustion chamber. During the expansion stroke, the expanding gases push the piston back to BDC. A crankshaft converts this piston movement into a rotational torque of the rotary shaft. During the exhaust stroke, in a traditional design, exhaust valve is opened to release the residual combusted air-fuel mixture to the corresponding exhaust passages and the piston returns to TDC.

The cylinder block 10 may have, for example, four cylinder bores 18 which are arranged in a row and of which one of the four cylinder bores is illustrated in FIG. 1. However, the engine 50 may include a different number of cylinder bores and/or the cylinders bores may be arranged in different configurations such as opposed configurations, in banks, in a V-style configuration, etc. For instance, the engine 50 may include one cylinder bore or two or more cylinder bores.

The cylinder bores 18 extend from an upper side 12 of the cylinder block 10 into the latter. Adjacent cylinder bores 18 form a web 24 which is arranged between the cylinder bores 18 and extends from the upper side 12 of the cylinder block 10 between the cylinder bores 18 into the cylinder block 10. As described herein, webs are pieces (e.g., continuous pieces) of material (e.g., metal such as steel, aluminum, magnesium, etc.) that form a portion of the cylinder block or head around coolant conduits in the block cooling jacket.

The section viewing plane of FIG. 1 is arranged perpendicularly to the upper side 12 of the cylinder block 10 and runs along an imaginary line of symmetry 20, on the upper side 12 of the cylinder block 10, between two adjacent cylinder bores 18.

The cylinder block 10 includes a coolant duct 22 which may at least partially circumferentially surround the cylinder bores 18 and may run outside the webs 24, for cooling the cylinder bores 18 using a coolant. In the vicinity of the coolant duct 22, threaded holes 16 which are arranged in the cylinder block 10 perpendicularly to the upper side 12 are provided. The threaded holes 16 allow the cylinder block 10 to be connected to a cylinder head and a cylinder head seal lying in between, if desired. Thus, the threaded holes may be used in such a manner when forming the internal combustion engine 50.

The coolant duct 22 includes a first section 54 and a second section 56. The first section 54 is positioned on a first side 58 of the cylinder block 10 and the second section 56 is positioned on a second side 60 of the cylinder block 10. In one example, intake valves may be positioned on the first side 58 of the cylinder block 10 and exhaust valves may be positioned on the second side 60 of the cylinder block or vice versa. In such an example, the first side 58 may be an intake side of the cylinder block 10 and the second side 60 may be an exhaust side of the cylinder block.

The coolant duct 22 having the first section 54 and the second section 56 is included in the cooling system 51. Additionally, the first section 54 is shown including an outlet 62 in fluidic communication with a heat exchanger 64 via a coolant line 66. It will be appreciated that the cooling system 51 may also include the heat exchanger 64. The heat exchanger 64 is designed to remove heat from the coolant flowing there through. To facilitate such heat removal the heat exchanger 64 may include fins, grooves, counter flow tubes, other suitable components, etc.

The heat exchanger 64 is in fluidic communication with a pump 68. The pump 68 is designed to adjust the flowrate of coolant through the cooling system 51. Therefore, in one example, the pump 68 may be a positive displacement pump, centrifugal pump, etc., increasing and decreasing the flowrate of coolant through the cooling system 51. For instance, the flowrate of the coolant in the cooling system may be permitted during certain operating conditions such as subsequent to engine warm-up and inhibited or decreased during other operating conditions such as warm-up. It may be determined that the engine is in a warm-up phase when the engine temperature is below a threshold value (e.g., 60° C., 70° C., 80° C., 90° C., etc.) The pump 68 is in fluidic communication with an inlet 70 in the first section 54 the coolant duct 22 via a coolant line 72. In this way, a coolant loop allowing for heat removal in the cylinder block 10 may be formed in the engine 50. In one example, the coolant loop in the cylinder block 10 may be fluidly separated from a coolant loop (e.g., coolant jacket) in the cylinder head. However, in other examples, the coolant loop in the cylinder block and the cylinder head may be in fluidic communication with one another.

Although, the coolant duct 22 is depicted as including the inlet 70 and the outlet 62 within the first section 54. It will be appreciated that alternate suitable coolant duct inlet and/or outlet locations have been contemplated. For instance, the inlet 70 may be included in the second section 56 of the coolant duct 22 or in other coolant ducts in the cooling system 51. Additionally or alternatively, the outlet 62 may be included in the second section 56 of the coolant duct 22 or in other suitable locations in the cooling system 51, such as other suitable coolant ducts. Furthermore, the outlet 62 of the coolant duct 22 is shown positioned above the inlet 70 of the coolant duct, in the illustrated example. However, the outlet 62 of the coolant duct 22 may be positioned below the inlet 70 of the coolant duct, in another example. Still further in another example, the outlet 62 and the inlet 70 may be positioned at substantially equivalent heights, on opposing sides of the cylinder block 10, etc. As such, numerous coolant flow patterns in the cylinder block have been contemplated.

In order to increase the cooling of the web 24 between the cylinder bores 18, the cylinder block 10 may be equipped in one or more of the three webs 24 with a connecting duct 26 which produces a connection in terms of flow between parts of the coolant duct 22 that are otherwise separated by the web 24. Specifically in one example, a connecting duct may be provided in each of the webs in the cylinder block 10. The connecting duct 26 may be designed in the same manner on all three webs 24 of the cylinder block 10, in one example. The design of one of the connecting ducts 26 is therefore described below by way of representation of all of the connecting ducts 26. However, in other examples, the connecting ducts may have geometric variations.

The connecting duct 26 is therefore included in the cooling system 51 and includes a first end 74 openings into the first section 54 of the coolant duct 22. Additionally, the connecting duct 26 includes a second end 76 opening into the second section 56.

In one example, the connecting duct 26 may be arranged completely within the web 24, and therefore subsections of the connecting duct 26 that are connected directly to the coolant duct 22 may be arranged spaced apart from the upper side 12 of the cylinder block 10.

The connecting duct 26 has a first subsection $\mathbf{30}_1$ and a second subsection $\mathbf{30}_2$ with a rectilinear center line $\mathbf{32}_1$, $\mathbf{32}_2$ in each case. An intersection 31 between the first subsection $\mathbf{30}_1$ and the second subsection $\mathbf{30}_2$ is also shown in FIG. 1. Furthermore, a center line 28 of the connecting duct 26 is shown in FIG. 1, said center line being composed of the center lines $\mathbf{32}_1$, $\mathbf{32}_2$ of the subsections $\mathbf{30}_1$, $\mathbf{30}_2$, lies completely in a plane of symmetry, which is arranged between two adjacently arranged cylinder bores 18, of the two cylinder bores 18. The section plane of FIG. 1 coincides with the plane of symmetry of the two cylinder bores 18.

At the first subsection $\mathbf{30}_1$ which is connected directly to that part of the coolant duct 22 which is illustrated on the left in FIG. 1, the center line 28 of the connecting duct 26 forms an obtuse angle $\alpha_1$ of approximately 115° with a direction 14 arranged perpendicularly to the upper side 12 of the cylinder block 10 ("vertical direction" below), on a side facing away from the upper side 12 of the cylinder block 10. However, other obtuse angles have been contemplated such at 100°, 105°, 120°, etc. In other examples, the angle $\alpha_1$ may not be obtuse.

At the second subsection $\mathbf{30}_2$ which is connected directly to that part of the coolant duct 22 which is illustrated on the right in FIG. 1, the center line 28 of the connecting duct 26 likewise forms an obtuse angle $\alpha_2$ of approximately 115° with the vertical direction 14 on a side facing away from the upper side 12 of the cylinder block 10. However, other obtuse angles have been contemplated such at 100°, 105°, 120°, etc. In other examples, the angle $\alpha$2 may not be obtuse. This arrangement is also illustrated in a simplified manner in FIG. 3A which enables the angles to be clearly discerned. The center lines $\mathbf{32}_1$, $\mathbf{32}_2$ of the two abutting subsections $\mathbf{30}_1$, $\mathbf{30}_2$ therefore form an obtuse angle $\gamma$ of approximately 130° at the abutment point, on a side facing away from the upper side 12 of the cylinder block 10. In other examples, the angle $\gamma$ may not be obtuse or the obtuse angle may be greater than or less than 130°.

Figure 3A:
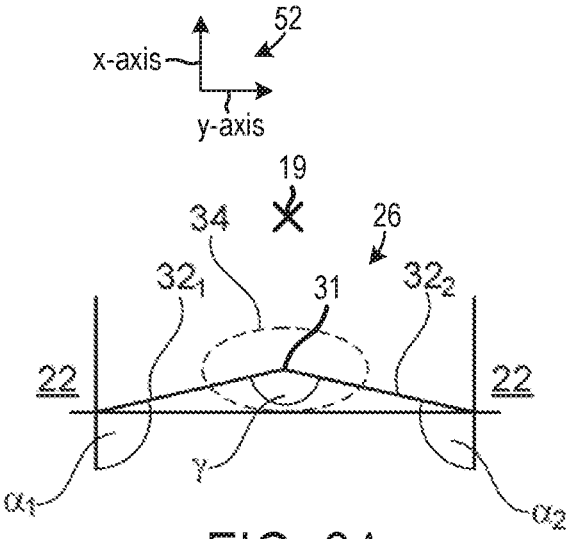
FIGS. 3A-3F show other illustrated examples of a connecting duct included in the cooling system, shown in FIG. 1.

In this specific embodiment, the obtuse angle $\alpha_1$ between the center line $\mathbf{32}_1$ of the first subsection $\mathbf{30}_1$ and the vertical direction 14, and the obtuse angle $\alpha_2$ between the center line $\mathbf{32}_2$ of the second subsection $\mathbf{30}_2$ and the vertical direction 14 are identical (FIG. 3A). In other embodiments, an obtuse angle $\alpha_1$ between the center line $\mathbf{32}_1$ of the first subsection $\mathbf{30}_1$ and the vertical direction 14, and an obtuse angle $\alpha_2$ between the center line $\mathbf{32}_2$ of the second subsection $\mathbf{30}_2$ and the vertical direction 14 can be designed to differ in size, as is shown by way of example in FIG. 3B.

FIG. 1 also shows a controller 100 that may be included in the cooling system 51. Specifically, controller 100 is shown in FIG. 1 as a conventional microcomputer including: microprocessor unit 102, input/output ports 104, read-only memory 106, random access memory 108, keep alive memory 110, and a conventional data bus. Controller 100 is configured to receive various signals from sensors coupled to the engine 50, cooling system 51, etc. The sensors may include engine coolant temperature sensor 120, ambient temperature sensor 122, etc.

Additionally, the controller 100 may be configured to trigger one or more actuators and/or send commands to components. For instance, the controller 100 may trigger adjustment of the pump 68, heat exchanger 64, etc. Specifically in one example, the controller 100 may send a control signal to the pump 68 to vary the flow of coolant through the cooling system 51. Therefore, the controller 100 receives signals from the various sensors and employs the various actuators to adjust engine operation based on the received signals and instructions stored in memory (e.g., non-transitory memory) of the controller. Thus, it will be appreciated that the controller 100 may send and receive signals from the cooling system 51.

In yet another example, the amount of component, device, actuator, etc., adjustment may be empirically determined and stored in predetermined lookup tables and/or functions. For example, one table may correspond to conditions related coolant flow during start-up and another table may correspond to conditions related to coolant flow subsequent to warm-up.

FIG. 3A also shows the intersection 31 between the first subsection $\mathbf{30}_1$ of the connecting duct 26 and the second subsection $\mathbf{30}_2$ of the connecting duct. At the intersection 31 an angle $\gamma$ is formed between the first subsection $\mathbf{30}_1$ and the second subsection $\mathbf{30}_2$. The angle $\gamma$ is formed in a plane formed by the x-axis and the y-axis that is perpendicular to the central axis 19 of the cylinder bore 18, shown in FIG. 1. The angle $\gamma$ shown in FIG. 3A is an obtuse angle. However, in other examples, the angle may be an acute angle. For instance, FIG. 3C illustrates an angle $\gamma$1 formed at the intersection 31 as an acute angle, discussed in greater detail herein. Thus, in one example, the angle $\gamma$ may be a non-straight angle. FIG. 3B shows again shows the angle $\gamma$ at the intersection 31. The angle $\gamma$ is an obtuse angle in the example shown in FIG. 3B. However, other angles have been contemplated. The central axis 19 and connecting duct 26 are also indicated in FIGS. 3B-3F for reference.

In other examples, of the connecting duct 26, an obtuse angle $\alpha_1$ may be formed between the center line $\mathbf{32}_1$ of the first subsection $\mathbf{30}_1$ and the vertical direction 14, and another obtuse angle $\alpha_2$ may be formed between the center line $\mathbf{32}_2$ of the second subsection $\mathbf{30}_2$ and the vertical direction 14, while the center lines $\mathbf{32}_1$, $\mathbf{32}_2$ of the two abutting subsections $\mathbf{30}_1$, $\mathbf{30}_2$ form an acute angle $\gamma$1 at their abutting point, on a side facing away from the upper side 12 of the cylinder block 10. A corresponding example is illustrated in FIG. 3C.

Figure 3B:
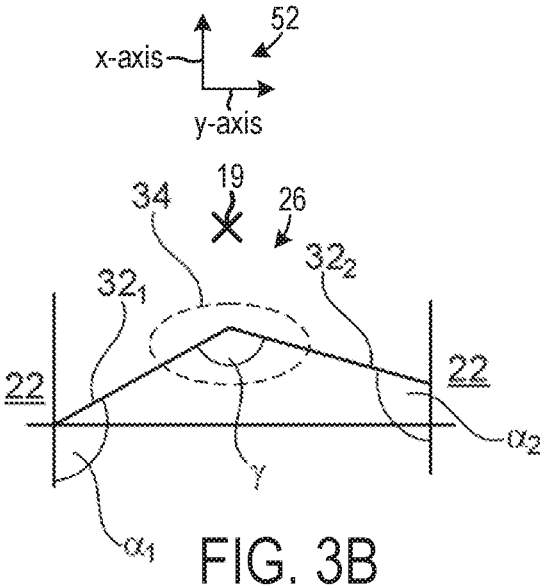
Figure 3C:
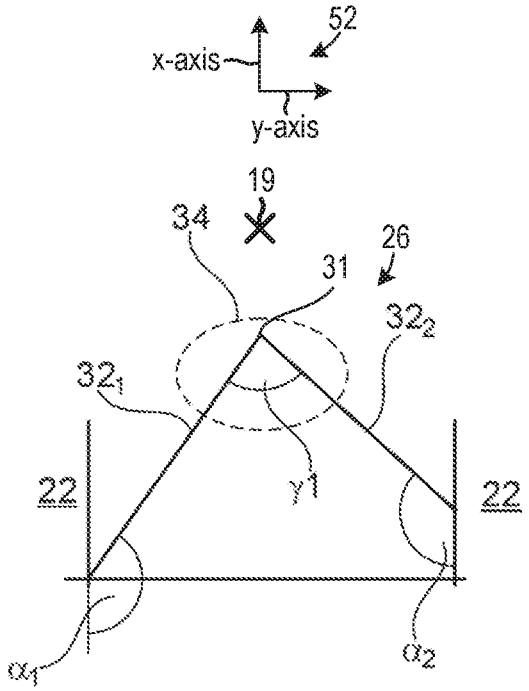
Figure 3D:
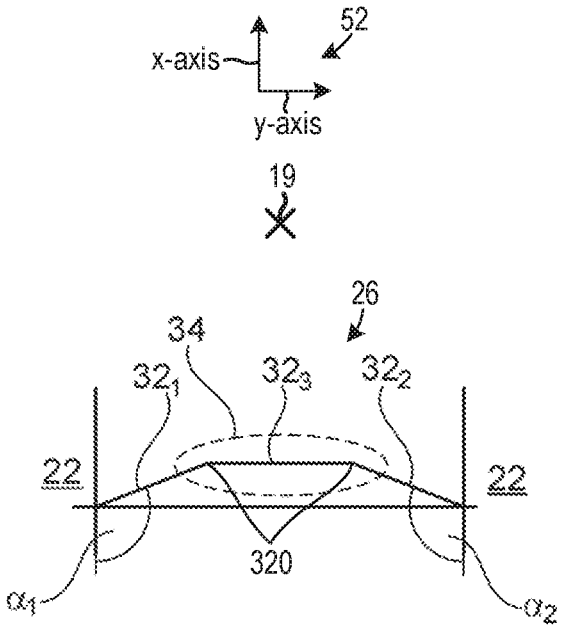
Figure 3E:
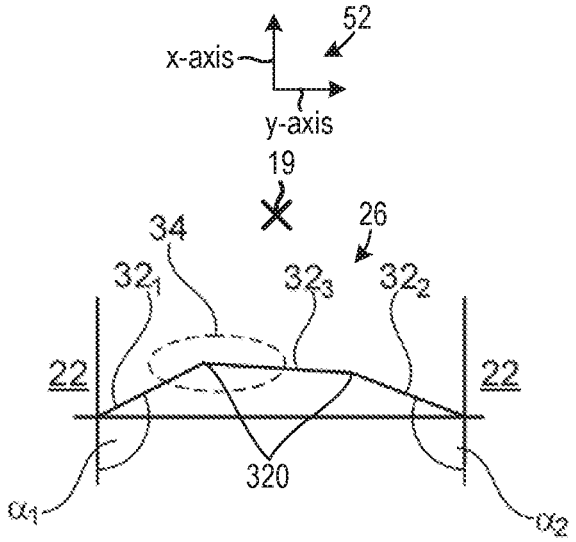

Although the connecting duct 26 shown in FIGS. 3A-3C has two subsections $\mathbf{30}_1$, $\mathbf{30}_2$ with a rectilinear center line $\mathbf{32}_1$, $\mathbf{32}_2$, it is likewise provided within the context of this description, in other examples, the connecting duct 26 may include more than two, for example three, subsections with a rectilinear center line $\mathbf{32}_1$, $\mathbf{32}_2$, $\mathbf{32}_3$, as shown in FIG. 3D and FIG. 3E. Specifically, FIG. 3D shows the connecting duct 26 including three subsections forming two intersections 320. In FIG. 3D the angles formed at the intersections 320 are obtuse. However, in other examples, the angles may be acute or one angle may be acute while the other angle may be obtuse. FIG. 3E again shows the connecting duct 26 with three subsections forming the two intersections 320. The angles formed at the intersections 320 in FIG. 3E are not equivalent. However, numerous suitable angles have been contemplated.

Figure 3F:
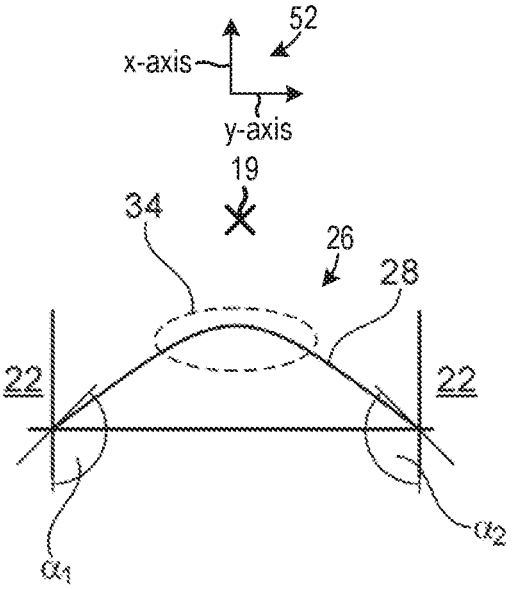

It can likewise be provided that the connecting duct 26, in another example, may have a multiplicity of subsections with a rectilinear center line, wherein said multiplicity can be a number of, for example, more than 50 or more than 100, and that a center line 28 of said connecting duct 26 then resembles a curved line, as is shown in FIG. 3F. Thus, the intersection between the subsections of the connecting duct 26 may be curved.

In the examples, illustrated in simplified form in FIGS. 3A-3F, the connecting duct 26 has a sub-region 34 which includes at least part of at least two subsections with a rectilinear center line $\mathbf{32}_1$, $\mathbf{32}_2$, and/or $\mathbf{32}_3$, wherein said sub-region 34 is arranged adjacent to the upper side 12 of the cylinder block 10. Vapor bubbles may potentially arise in the coolant due to heating in a hot-running phase of the internal combustion engine will collect in the sub-region 34, as a result of which a coolant flow through the connecting duct 26 may be inhibited.

To remedy this, a venting duct 36 of rectilinear design may be provided at each of the connecting ducts 26 in the cylinder block 10, as shown in FIG. 1. The venting duct 36 may be included in the cooling system 51. The venting duct 36 connects the subsections $30_1$, included in the sub-region 34, of the connecting duct 26 to the upper side 12 of the cylinder block 10 in terms of flow, from where said flow can be conducted away through specially provided openings in the cylinder head seal into a coolant duct of the cylinder head (not illustrated), and therefore a constant coolant flow through the connecting duct 26 can be achieved, if desired. However, in other examples, the venting duct 36 may not be included in the cylinder block 10 and the cooling system 51 or the venting duct 36 may be coupled to the subsection $30_2$.

FIG. 2 shows an example of a cross-sectional area 38 of the connecting duct 26 of the cylinder block 10 in a section plane perpendicular to the center line $32_1$ of the subsection $30_1$. The cross-sectional area 38 may have a first circular-segment-shaped area portion 40 and a second circular-segment-shaped area portion 42, which are both designed in each case as a semicircular area, and therefore a chord bounding the respective area portion 40, 42 corresponds to a diameter of the respective circle. The first circular-segment-shaped area portion 40 and the second circular-segment-shaped area portion 42 may be arranged spaced apart from each other in the vertical direction 14, wherein the first circular-segment-shaped area portion 40 is arranged closer to the upper side 12 of the cylinder block 10. The first circular-segment-shaped area portion 40 may have an area content which is smaller than an area content of the second circular-segment-shaped area portion 42.

The cross-sectional area 38 of the connecting duct 26 furthermore has a trapezoidal area portion 44 which is designed in particular in the form of an equilateral trapezoid and is arranged between the first circular-segment-shaped area portion 40 and the second circular-segment-shaped area portion 42 and in a manner adjoining said area portions, in the illustrated example. However, numerous connecting duct 26 profiles, contours, etc., have been contemplated. The shorter of the two parallel sides of the trapezoid coincides with the chord (the diameter) of the first circular-segment-shaped area portion 40, in the illustrated example. The longer of the two parallel sides of the trapezoid coincides with the chord (the diameter) of the second circular-segment-shaped area portion 42. As is apparent from FIG. 2, the cross-sectional area 38 of the connecting duct 26 may thereby be designed without corners. The corner within the connecting duct 26 arises at the abutting point of the two abutting subsections $30_1$, $30_2$, and therefore the advantages described with respect to a flow of the coolant and to absorption and dissipation of forces occurring during operation of the internal combustion engine are achieved.

FIGS. 1-3F show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

The cooling system and engine with the cylinder block described herein provide the technical effect of increasing cylinder block cooling while maintaining a desired structural integrity in the cylinder block. Consequently, engine efficiency can be increased along with an increase in engine longevity and durability.

The invention will be further described in the following paragraphs. In one aspect, a cylinder block of an internal combustion engine is provided that includes at least two cylinder bores which extend from an upper side of the cylinder block into the latter, a web which is arranged between the cylinder bores and extends from the upper side of the cylinder block between the cylinder bores into the cylinder block, a coolant duct surrounding the cylinder bores at least partially circumferentially and running outside the web, for cooling the cylinder bores with a coolant, and a connecting duct arranged completely within the web and producing a connection in terms of flow between parts of the coolant duct that are otherwise separated by the web, where, at subsections of the connecting duct that are connected directly to the coolant duct, a center line of the connecting duct forms an obtuse angle with a direction arranged perpendicularly to the upper side of the cylinder block, on a side facing away from the upper side of the cylinder block, and where the subsections of the connecting duct extend inwardly toward a central axis of one of the at least two cylinder bores and are not connected to any coolant conduits other than the coolant duct.

In another aspect, an internal combustion engine is provided that includes a cylinder block of an internal combustion engine comprising at least two cylinder bores which extend from an upper side of the cylinder block into the latter, a web which is arranged between the cylinder bores and extends from the upper side of the cylinder block between the cylinder bores into the cylinder block, a coolant duct surrounding the cylinder bores at least partially circumferentially and running outside the web, for cooling the cylinder bores with a coolant, and a connecting duct arranged completely within the web and producing a connection in terms of flow between parts of the coolant duct that are otherwise separated by the web, where, at subsections of the connecting duct that are connected directly to the coolant duct, a center line of the connecting duct forms an obtuse angle with a direction arranged perpendicularly to the upper side of the cylinder block, on a side facing away from the upper side of the cylinder block, and where the subsections of the connecting duct extend inwardly toward a central axis of one of the at least two cylinder bores and are not connected to any coolant conduits other than the coolant duct.

In another aspect, a cooling system in an engine is provided that includes a cylinder bore including a central axis, a coolant duct including a first section positioned on a first side of the cylinder bore and a second section positioned on a second side of the cylinder bore, a connecting duct extending between the first section and the second section and including a first end opening into the first section and a second end opening into the second section, where the connecting duct includes a first subsection and a second subsection extending inwardly toward the central axis, and where an intersection of the first subsection and the second subsection in a plane perpendicular to the central axis forms a non-straight angle.

In another aspect, an engine cooling system is provided that includes a connecting duct extending between a first and second section of a coolant duct positioned on opposing sides of the cylinder bore and including two ends each opening into the first and second sections, respectively, where the connecting duct includes subsections each extending inwardly toward the central axis and an intersection of the subsections in a plane perpendicular to a central axis of the cylinder bore forms a non-straight angle.

In any of the aspects or combinations of the aspects, the center line of the connecting duct may lie substantially completely in a plane of symmetry of two adjacently arranged cylinder bores of the at least two cylinder bores.

In any of the aspects or combinations of the aspects, the connecting duct may have at least two subsections and where each of the two subsections has a rectilinear center line.

In any of the aspects or combinations of the aspects, the rectilinear center lines of the at least two subsections may form an obtuse angle on a side facing away from the upper side of the cylinder block.

In any of the aspects or combinations of the aspects, a cross-sectional area of the connecting duct may comprise a first circular-segment-shaped area portion, a second circular-segment-shaped area portion and a trapezoidal area portion, in a plane perpendicular to the center line, where the trapezoidal area portion is arranged between the first circular-segment-shaped area portion and the second circular-segment-shaped area portion.

In any of the aspects or combinations of the aspects, the first circular-segment-shaped area portion may have an area which is smaller than an area of the second circular-segment-shaped area portion.

In any of the aspects or combinations of the aspects, the first circular-segment-shaped area portion may be arranged closer to the upper side of the cylinder block than the second circular-segment-shaped area portion.

In any of the aspects or combinations of the aspects, at least one of the first and second circular-segment-shaped area portions may have a semicircular area.

In any of the aspects or combinations of the aspects, the cylinder block may further include a venting duct connecting a sub-region of the connecting duct, where the sub-region faces toward the upper side of the cylinder block.

In any of the aspects or combinations of the aspects, there may be no coolant conduits connected to the connecting duct between the first end and the second end.

In any of the aspects or combinations of the aspects, the non-straight angle may be an obtuse angle.

In any of the aspects or combinations of the aspects, the non-straight angle may be an acute angle.

In any of the aspects or combinations of the aspects, the first side of the cylinder bore may be an intake side of the cylinder bore and where the second side of the cylinder bore may be an exhaust side of the cylinder bore.

In any of the aspects or combinations of the aspects, an angle of an intersection between the first subsection and the first section may be different from an angle of an intersection between the second subsection and the second section.

In any of the aspects or combinations of the aspects, the cooling system may further include a venting conduit in fluidic communication with the connecting duct.

In any of the aspects or combinations of the aspects, the cooling system may further include a pump and a heat exchanger in fluidic communication with the coolant duct.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A cylinder block of an internal combustion engine comprising:

at least two cylinder bores which extend from an upper face of the cylinder block into the cylinder block;

a web which is arranged between the cylinder bores and extends from the upper side of the cylinder block between the cylinder bores into the cylinder block;

a coolant duct surrounding the cylinder bores at least partially circumferentially and running outside the web, for cooling the cylinder bores with a coolant; and a connecting duct arranged completely within the web and producing a connection in terms of flow between parts of the coolant duct that are otherwise separated by the web;

the connecting duct comprised of subsections connected directly to the coolant duct, center lines of the subsections form obtuse angles with a direction perpendicular to the upper face of the cylinder block and the center lines of the subsections intersect at an angle in a plane perpendicular to a central axis of one of the the at least two cylinder bores; and where the subsections of the connecting duct extend inwardly toward the central axis of one of the at least two cylinder bores and are not connected to any coolant conduits other than the coolant duct.

2. The cylinder block of claim 1, wherein obtuse angles formed by the center lines of the subsections are different.

3. The cylinder block of claim 1, wherein the center lines of the subsections form obtuse angles with the coolant duct in a plane perpendicular to the center axis of the cylinder bores center lines.

4. The cylinder block of claim 3, wherein the obtuse angles with the coolant duct in the plane perpendicular to the central axis of the cylinder bores are different.

5. The cylinder block of claim 1, where a cross-sectional area of the connecting duct comprises a first circular-segment-shaped area portion, a second circular-segment-shaped area portion and a trapezoidal area portion, in a plane perpendicular to the center lines, where the trapezoidal area portion is arranged between the first circular-segment-shaped area portion and the second circular-segment-shaped area portion.

6. The cylinder block of claim 5, where the first circular-segment-shaped area portion has an area which is smaller than an area of the second circular-segment-shaped area portion.

7. The cylinder block of claim 5, where the first circular-segment-shaped area portion is arranged closer to the upper face of the cylinder block than the second circular-segment-shaped area portion.

8. The cylinder block of claim 5, where at least one of the first and second circular-segment-shaped area portions has a semicircular area.

9. The cylinder block of claim 1, further comprising a venting duct connecting the connecting duct to the upper face of the cylinder block, wherein the connecting duct does not include an inlet or outlet in the upper face of the cylinder block.

10. An internal combustion engine comprising:

a cylinder block of the internal combustion engine comprising:

at least two cylinder bores which extend from an upper side of the cylinder block into the cylinder block;

a web which is arranged between the cylinder bores and extends from the upper side of the cylinder block between the cylinder bores into the cylinder block;

a coolant duct surrounding the cylinder bores at least partially circumferentially and running outside the web, for cooling the cylinder bores with a coolant; and a connecting duct arranged completely within the web and producing a connection in terms of flow between parts of the coolant duct that are otherwise separated by the web; and subsections of the connecting duct connect directly to the coolant duct, center lines of the subsections of the connecting duct form obtuse angles with a direction perpendicular to the upper side of the cylinder block, on a side facing away from the upper side of the cylinder block, and the center lines of the subsections intersect at a non-zero angle in a plane perpendicular to a central axis of one of the at least two cylinder bores; and where the subsections of the connecting duct extend inwardly toward the central axis of one of the at least two cylinder bores and are not connected to any coolant conduits other than the coolant duct.

11. The internal combustion engine of claim 10, where there are no coolant conduits connected to the connecting duct between a first end and a second end.

12. An engine cooling system comprising:

a connecting duct extending through a web between cylinder bores and the connecting duct extending between a first and a second section of a coolant duct positioned on opposing sides of one of the cylinder bore and including two ends each opening into the first and second sections, respectively; and the connecting duct includes subsections each extending inwardly toward an interior of a web and an intersection of central axes of the subsections in a plane perpendicular to a central axis of the cylinder bore forming a non-straight angle and the central axes of each subsection intersects with a respective section of the coolant duct at an obtuse angle in the plane perpendicular to the central axis of the cylinder bore.

13. The engine cooling system of claim 12, wherein the obtuse angles of the intersections between the subsections of the connecting duct and the respective sections of the coolant duct have different values.

14. The engine cooling system of claim 12, wherein there are three subsections of the connecting duct forming two intersections in a plane perpendicular to the central axis of the cylinder bore and the two intersections form two obtuse angles.

15. The engine cooling system of claim 12, wherein there are three subsections of the connecting duct forming two intersections in a plane perpendicular to the central axis of the cylinder bore and the two intersections form one obtuse angle and one acute angle.

16. The engine cooling system of claim 12, wherein the intersection of the subsections and intersection of each subsection with a respective section of the coolant duct form three angles of different values.

17. The engine cooling system of claim 12, where an angle of an intersection between a first subsection and the first section is different from an angle of an intersection between a second subsection and the second section.

18. The engine cooling system of claim 12, where the intersection of the subsections is curved.

19. The engine cooling system of claim 12, further comprising a venting conduit in fluidic communication with the connecting duct.

20. The engine cooling system of claim 12, further comprising a pump and a heat exchanger in fluidic communication with the coolant duct.

* * * * *